US011621504B2

(12) United States Patent
Moser

(10) Patent No.: US 11,621,504 B2
(45) Date of Patent: Apr. 4, 2023

(54) RESILIENT FORCE CLAMPING CONNECTION AND TERMINAL BLOCK HAVING A RESILIENT FORCE CLAMPING CONNECTION

(71) Applicant: Electro Terminal GmbH & Co. KG, Innsbruck (AT)

(72) Inventor: Peter Moser, Stans (AT)

(73) Assignee: Electro Terminal GmbH & Co. KG, Innsbruck (AT)

( * ) Notice: Subject to any disclaimer, the term of this patent is extended or adjusted under 35 U.S.C. 154(b) by 6 days.

(21) Appl. No.: 17/336,526

(22) Filed: Jun. 2, 2021

(65) Prior Publication Data

US 2021/0399444 A1 Dec. 23, 2021

(30) Foreign Application Priority Data

Jun. 19, 2020 (DE) ..... 20 2020 103 553.3

(51) Int. Cl.
*H01R 9/24* (2006.01)
*H01R 9/22* (2006.01)

(52) U.S. Cl.
CPC ..... *H01R 9/2416* (2013.01); *H01R 9/223* (2013.01); *H01R 9/2458* (2013.01)

(58) Field of Classification Search
CPC .... H01R 9/223; H01R 9/2458; H01R 4/4818; H01R 4/4827; H01R 4/4836
See application file for complete search history.

(56) References Cited

U.S. PATENT DOCUMENTS 6,074,241 A 6/2000 Patel et al.
8,444,443 B2 * 5/2013 Schafmeister ..... H01R 4/4836 439/441

(Continued)

FOREIGN PATENT DOCUMENTS

DE 202005018168 U1 1/2006
DE 202006020822 U1 8/2010

(Continued)

OTHER PUBLICATIONS

Machine translation for DE 102018124623.

(Continued)

*Primary Examiner* — Oscar C Jimenez
*Assistant Examiner* — Paul D Baillargeon
(74) *Attorney, Agent, or Firm* — The H.T. Than Law Group

(57) ABSTRACT

The present invention is directed to a resilient force clamping connection (2) for a terminal block (1), in particular a connection terminal or connecting terminal, so as to electrically connect at least one conductor, said resilient force clamping element comprising a busbar (3), and a clamping spring (4) having a support limb (40), a resilient bend (41) that adjoins the support limb (40), and a clamping limb (42) that adjoins the resilient bend (41), wherein the clamping limb (42) comprises at a free end (420) that is remote from the resilient bend (41) a clamping section (421) so as to form a conductor clamping site (K) between the clamping section (421) and the busbar (3) so as to electrically connect a conductor (L) to the resilient force clamping connection (2). At least one actuating limb (43) extends from the clamping limb (42) between the resilient bend (41) and the free end (420) in a direction away from the support limb (40), wherein the actuating limb (43) comprises an actuating section (430) in order to cooperate with a release element (5) so as to open the conductor clamping site (K). The present invention is further directed to a terminal block (1) so as to electrically connect at least one conductor, said terminal block comprising an insulated housing (6) and at least one resilient force clamping connection (2) according to the present invention and being received at least in part by the insulated housing (6).

20 Claims, 11 Drawing Sheets

(56) References Cited

U.S. PATENT DOCUMENTS

| | | | | |
|---|---|---|---|---|
| 9,437,940 | B1 | 9/2016 | Rao et al. | |
| 10,193,245 | B2 * | 1/2019 | Lorenschat | H01R 4/4845 |
| 2021/0218161 | A1 * | 7/2021 | Froebing | H01R 11/11 |

FOREIGN PATENT DOCUMENTS

| | | | |
|---|---|---|---|
| DE | 202018004944 | U1 | 1/2020 |
| DE | 102018124623 | A1 | 4/2020 |

OTHER PUBLICATIONS

Machine translation for DE 202005018168.
Machine translation of DE 202006020822.
Machine translation of DE 202018004944.
Search Report issued in connection with the corresponding German application No. 20 2020 103 553.3.
Certified priority document U.S. Appl. No. 63/040,815, filed Jun. 18, 2020.

* cited by examiner

RESILIENT FORCE CLAMPING CONNECTION AND TERMINAL BLOCK HAVING A RESILIENT FORCE CLAMPING CONNECTION

FIELD OF THE INVENTION

The present invention relates to a resilient force clamping connection and a terminal block that is equipped with a resilient force clamping connection.

BACKGROUND OF THE INVENTION

Resilient force clamping connections and terminal blocks equipped with resilient force clamping connections are known from the prior art. The resilient force clamping connection is in this case generally received in an insulated housing of the terminal block. The resilient force clamping connection generally comprises a busbar and a clamping spring that is held therein. The clamping spring comprises a pivotable clamping limb, the free end of which together with the busbar forms a clamping site which can be optionally opened so as to place or receive therein an electrical conductor. So as to open said clamping site, it is possible either to place against the clamping spring a separate tool which can be inserted for example via an opening that extends as far as the clamping spring. It is also known to integrate into the terminal block itself release elements, such as levers or pushers, which so as to open the clamping site pivot the clamping spring outwards by means of a defined movement. Since the clamping spring is arranged integrated in the insulated housing not least for safety reasons and the release level must be accessible to a user from the outside, appropriate release elements are generally embodied quite large and/or protrude far out of the insulated housing and consequently delimit a possible miniaturization of such terminal blocks.

SUMMARY OF THE INVENTION

It is consequently an object of the present invention to provide a resilient force clamping connection and a terminal block that is equipped with such a resilient force clamping connection and confronts the aforementioned disadvantages of the prior art and renders possible in particular a compact as possible construction.

In accordance with a first aspect, the present invention relates to a resilient force clamping connection for a terminal block, in particular a connection terminal or connecting terminal so as to electrically connect at least one conductor. The resilient force clamping connection comprises a busbar and at least one clamping spring. It is also possible to provide for each busbar two or more clamping springs which can be arranged particularly preferably adjacent to one another in a row or also opposite one another. The clamping spring comprises a support limb, a resilient bend that adjoins the support limb, and a clamping limb that adjoins the resilient bend. The clamping limb comprises at a free end that is remote from the resilient bend a clamping section so as to form a conductor clamping site (also referred to below as a clamping site) between the clamping section and the busbar so as to electrically connect a conductor to the resilient force clamping connection. At least one actuating limb extends from the clamping limb between the resilient bend and the free end in a direction away from the support limb (in other words in the upward direction or laterally out of the clamping spring or rather out of the region, which is delimited by the support limb, resilient bend and clamping limb, or rather if provided out of the U-shape of the clamping spring). The actuating limb comprises an actuating section in order to cooperate with a release element so as to open the conductor clamping site. Thus, the actuating section is therefore preferably to be embodied in such a manner that when the actuating section interacts with a release element the clamping limb can be pivoted in such a manner that the clamping site can be opened so as to feed-in/remove an electrical conductor.

By virtue of the actuating limb(s) or rather actuating section(s) which protrudes/protrude laterally upwards out of the clamping spring, it is possible to shorten an access path of a release element. Consequently, it is not necessary for a release element to advance as far as the "actual clamping spring" (in other words in particular as far as the clamping limb) since the clamping spring can already be actuated at the upright tab (in other words the actuating limb). It is thus possible to configure a separate release element of smaller dimensions and it does not need to penetrate as far into the terminal block in order to open the clamping site. In particular when using such a resilient force clamping connection in a terminal block having an insulated housing and integrated release element, the latter can be embodied so small and preferably also so planar that it is possible to reduce the installation size overall with respect to known solutions.

It is preferred that at least the resilient bend or the entire clamping spring can be embodied essentially in a U-shape. It is possible in this manner to provide a clamping spring that is particularly compact. The term "essentially U-shaped" is to be understood within the scope of the invention to mean that the basic shape is fundamentally two opposite-lying limbs that are oriented essentially at least in part inclined and/or parallel with respect to one another (here: support limb, clamping limb) which are connected to one another by means of a further limb (here: resilient bend). The three elements "support limb", "resilient bend" and "clamping limb" can therefore preferably form or determine essentially a U-shape of the clamping spring.

Irrespective of a U-shape of the clamping spring, the limbs (support limb, resilient bend, clamping limb, actuating limb) can themselves each comprise any desired number of sections that are bent and/or curved with respect to one another.

The busbar and the clamping spring are preferably produced from a metal, preferably sheet metal. These components are particularly preferably produced in a stamping-bending process.

Both the busbar and also the clamping spring are preferably embodied as stamped-bent parts. The actuating limbs are in this case particularly preferably stamped out of the clamping spring and accordingly curved upwards (for example in the direction of a release element).

The clamping section is preferably embodied as a clamping edge in order to provide preferably a high or rather concentrated clamping force.

The at least one actuating limb can extend preferably laterally with respect to the clamping limb accordingly away from the clamping limb. It is particularly preferred to provide two actuating limbs that then extend on both sides of the clamping limb accordingly away from the clamping limb. By virtue of the lateral arrangement of the actuating limb with respect to the clamping limb, it is possible on the one hand to realize the actuating limb in a simple manner, without on the other hand functionally interfering with the effective range of the clamping spring—in particular a conductor feed-in duct. Thus, the clamping limb and the actuating limb are consequently arranged as far as their function is concerned laterally adjacent to one another. In addition, the arrangement of the actuating limb on both sides with respect to the clamping limb has the advantage of a uniform as possible distribution of force during the procedure of opening the clamping site.

The actuating section can preferably be provided at a free end of the actuating limb, said free end being remote from the clamping limb. Consequently, the actuating section can preferably be provided in such a manner that the majority of it is easily accessible and can be reached and or actuated by a release element of any type.

The actuating limb can preferably comprise a bend section at a free end, preferably on the actuating section, said free end being remote from the clamping limb. It is consequently possible to securely integrate (for example without interlocking) the actuating section and the release element. It is preferred that the actuating section is curved in this case in the direction of the clamping section or rather of the clamping edge or of the conductor clamping site with the result that the actuating element can be safely engaged on a side that is remote from the clamping section, which renders possible in particular a small as possible effective force and preferred kinematics.

The busbar can preferably comprise a conductor feedthrough opening. The clamping site preferably lies adjacent to the conductor feedthrough opening and in particular when viewed in the conductor feed-in direction upstream of the conductor feedthrough opening. It is consequently possible to securely receive and make electrical contact with an electrical conductor that has been fed in.

The clamping spring can preferably be mounted with its support limb in the busbar and preferably clipped therein. In this case, the clamping spring can be mounted/clipped in particularly preferably on a mounting side of the conductor feedthrough opening in such a manner that the clamping limb lies at a side that is remote from the mounting side against the busbar so as to form the conductor clamping site, and preferably as desired in the case of an open conductor clamping site reveals the conductor feedthrough opening at least in part in a conductor feed-in direction. The clamping spring can consequently be held securely.

Moreover, the clamping spring can extend preferably in an inclined manner with respect to a conductor feed-in direction in order to form a feed-in chamfer for an electrical conductor that is to be fed in towards the clamping site.

In accordance with a further aspect, the present invention relates to a terminal block, in particular a connection terminal or connecting terminal, so as to electrically connect at least one electrical conductor, said terminal block comprising an insulated housing and at least one resilient force clamping connection that is in accordance with the present invention and is received at least in part by the insulated housing.

Consequently, a terminal block comprising a resilient force clamping connection in accordance with the invention is provided, which on the one hand provides all the aforementioned advantages. On the other hand, the resilient force clamping connection can thus be provided securely in an insulated housing and preferably securely received or rather mounted in said insulated housing.

The insulated housing is preferably produced from synthetic material. It is preferred that the insulated housing is produced using an injection molding method. The insulated housing can be embodied as one piece or from a plurality of pieces.

The clamping limb and each of the actuating limbs, at least of the actuating section of the respective actuating limb, can be separated from one another preferably by means of a partition wall that is formed by the insulated housing; this particularly preferably in each actuating position of the clamping spring. The partition wall can comprise for this purpose as required corresponding recesses in order to render possible an appropriate separation over the entire movement path of the clamping limb and consequently of the actuating limb. In this manner, the actuating region on the one hand and the clamping limb or rather the clamping site on the other hand can be laterally spatially separated from one another with the result that a possible release element does not make contact with an electrical conductor that is fed into a conductor feed-in space or rather into a clamping space. This increases the security of the terminal block and also increases its robustness with regard to its function.

The insulated housing can preferably comprise for each clamping site or rather clamping spring at least one conductor feed-in duct that extends in a conductor feed-in direction to the conductor clamping site. It is thus possible for the insulated housing to assume the function of guiding the conductor in a defined manner to the clamping site. In a particularly preferred configuration, the partition wall delimits in this case the conductor feed-in duct at least in part laterally with the result that the partition wall can moreover assume the function of guiding the conductor.

Moreover, the terminal block can comprise a release element (for example a release lever or a release slide) which can be moved between an idle position in which the clamping limb pushes into a closed position of the conductor clamping site, and an actuating position in which the release element cooperates with the actuating limb in such a manner that the conductor clamping site is opened. By virtue of integrating a release element in the terminal block, it is possible to increase the functionality of the terminal block and to forego a separate release element.

The release element is preferably produced from synthetic material. It is preferred that the release element is produced using an injection molding method The release element can be preferably arranged on a side of the clamping limb, said side lying opposite the support limb. In this manner, the release element of the actuating limb or rather of its actuating section is easily accessible. In addition, this relative arrangement facilitates a particularly compact construction of the terminal block having the release element.

The release element can be embodied preferably in a planar manner, moreover preferably extending essentially in one plane. This is possible in a simple manner merely as a result of the actuating limb that extends to the release element and facilitates an overall particularly planar construction of the terminal block In this case, it is preferred that in the idle position the release element can extend preferably along one side of the insulated housing or essentially laterally with respect to the resilient force clamping connection or laterally with respect to the conductor feed-in duct or parallel to a conductor feed-in direction, which in turn represents particularly preferred positions and orientations for a compact construction.

The release element can preferably comprise a clamping spring actuating section with which it cooperates at least in the actuating position with the actuating limb, preferably with the actuating section of said actuating limb, so as to open the conductor clamping site. Moreover, the release element can comprise a lever actuating section so as to move the release element between the idle position and the actuating position. The clamping spring actuating section and the lever actuating section are in this case particularly preferably provided on opposite-lying ends of the release element. In this manner, the lever forces can be distributed in a favorable manner with the result that on the one hand a user can open the clamping site in a simple manner and on the other hand the forces that act on the insulated housing can be kept as small as possible.

The release element can be mounted preferably in a rotational and/or translational manner in the housing in order for the release element to be moved between the idle position and the actuating position. In this case, a release lever is conceivable which can be pivoted about an axis of rotation—for example mounted in the housing. Also conceivable is a release slide which can be moved in a translational manner along corresponding guide structures in the release slide on the one hand and insulated housing on the other hand. Also other configurations of a release element are conceivable and likewise covered by the present invention.

In the case of the rotational mounting, an axis of rotation of the release element can preferably extend in a transverse manner or perpendicular to the resilient force clamping connection and preferably to a conductor feed-in direction or to the conductor feed-in path. It is particularly preferred that the axis of rotation extends laterally outside a conductor feed-in duct. In this manner, it is possible to realize a kinematically preferred mounting of the release element. In addition, it is possible on the one hand to realize a compact construction (not least as a result of the actuating limb in accordance with the invention and also the associated possibility of realizing a compact release element) whilst on the other hand it is possible to avoid a collision between the axis of rotation and the conductor that is to be fed in.

The release element can preferably comprise mounting sections so as to provide the rotational and/or translational mounting in the insulated housing. The insulated housing then preferably comprises accordingly corresponding mounting sections. It is consequently possible to realize a secure and defined mounting arrangement. It is particularly preferred that the mounting sections are arranged between the clamping spring actuating section and the lever actuating section with the result that the release element can be embodied in a kinematic optimized manner whilst simultaneously realizing as compact a construction as possible. It is also rendered possible to realize a favorable distribution of force as a result of the provided lever arms.

BRIEF DESCRIPTION OF THE DRAWINGS

Further configurations, features and advantages of the present invention are described below with the aid of the Figures and accompanying drawings. In the drawings.

DETAILED DESCRIPTION OF THE PREFERRED EMBODIMENTS

Figure 1:
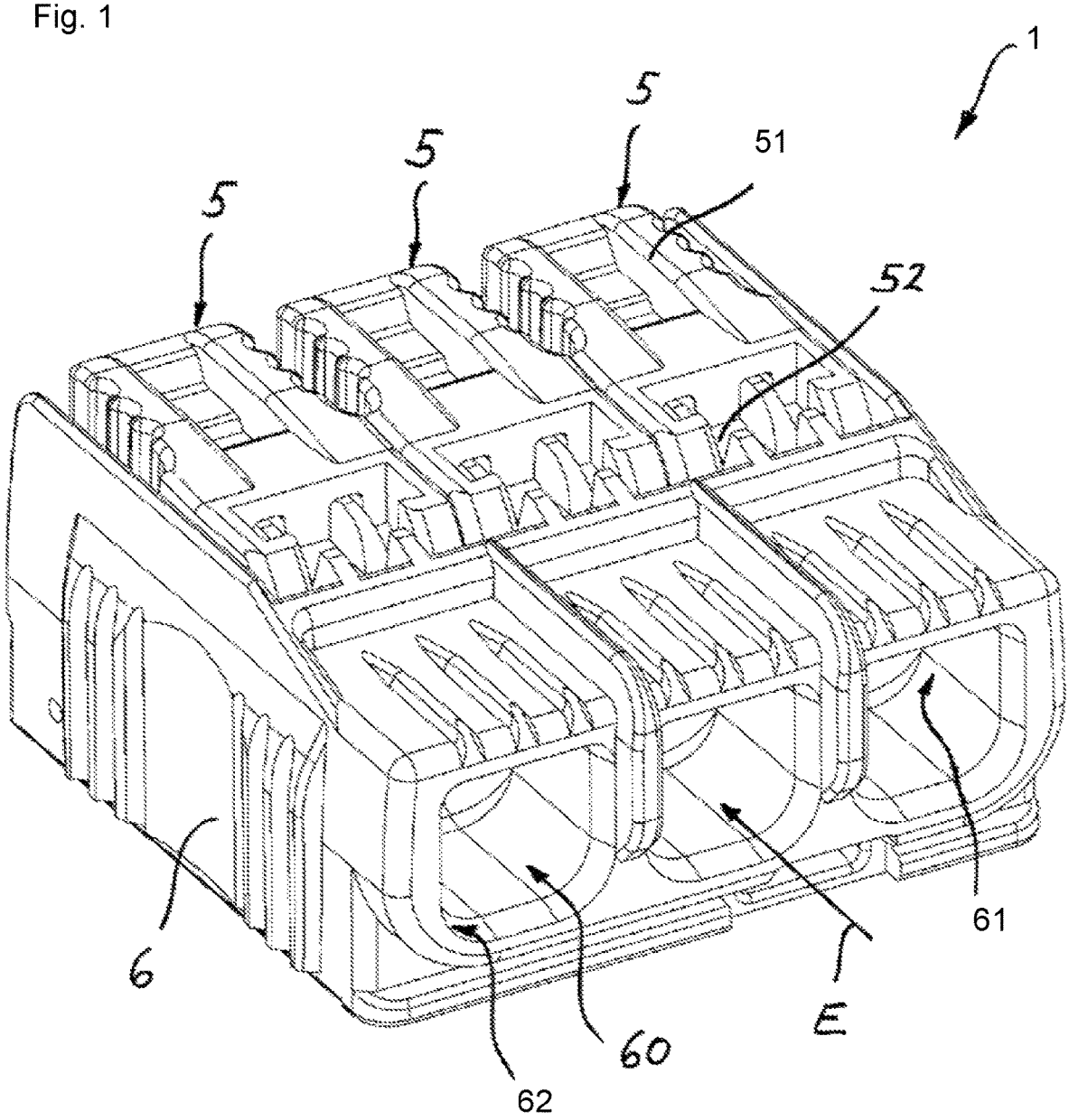
FIG. 1 illustrates a perspective view of a terminal block in accordance with the invention having a resilient force clamping connection in accordance with the invention in accordance with an exemplary embodiment of the present invention.

The Figures illustrate different views of a terminal block 1 in accordance with the invention and of a resilient force clamping connection 2 in accordance with the invention for such a terminal block 1. The terminal block 1 is preferably a connection terminal or connecting terminal. The terminal block 1 or rather the resilient force clamping connection 2 serves to electrically connect at least one electrical conductor.

Initially, the resilient force clamping connection 2 is described with reference to FIGS. 2 to 5 (i.e. FIGS. 2A, 2B, 3A, 3B, 4A, 4B, 4C, 5A, 5B and 5C).

The resilient force clamping connection 2 comprises a busbar 3 and at least one clamping spring 4. The clamping spring 4, as illustrated, can be preferably embodied in an essentially U-shaped manner. In the illustrated embodiment, three clamping springs 4 are provided here for each busbar 3 and said clamping springs are provided or arranged adjacent to one another in a row, as is apparent in particular in FIGS. 5A and 5C. However, it is also conceivable to provide fewer or more clamping springs 4 for each busbar 3 and also to arrange them in a different manner relative to one another (for example opposite one another). The invention is not limited here to the number and arrangement of the clamping springs 4 for each busbar 3.

The clamping spring 4 in turn comprises a support limb 40, a resilient bend 41 that adjoins the support limb 40, and a clamping limb 42 that adjoins the resilient bend 41. These three elements 40-42 form in this case in accordance with the illustrated exemplary embodiment essentially the U-shape of the clamping spring 4, as is apparent for example in FIGS. 2A, 3A, 4A and 5B. It is preferred that at least the resilient bend 41 is U-shaped.

The clamping limb 42 comprises at a free end 420 that is remote from the resilient bend 41 a clamping section 421 so as to form a conductor clamping site K between the clamping section 421 and the busbar 3 so as to electrically connect a conductor to the resilient force clamping connection 2. In this case, the busbar 3 comprises preferably a clamping edge section 30 against which the clamping section 421 lies securely and in addition against which the clamping limb 42 or rather its clamping section 421 pushes as a result of the resilient force of the clamping spring 4. The clamping section 421 is preferably embodied as a clamping edge in order to provide a concentrated as possible clamping force so as to securely connect an electrically conductor in the conductor clamping site K.

Figure 2A:
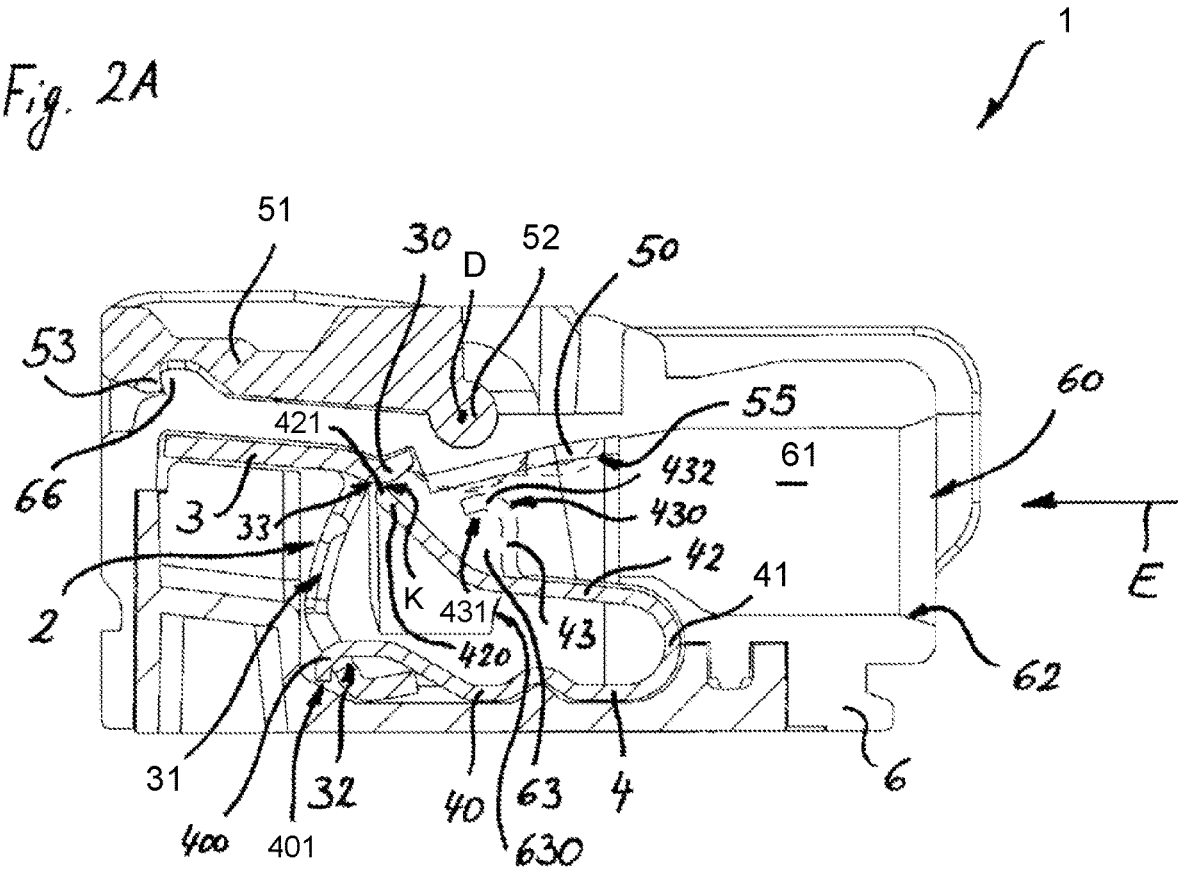
FIG. 2A illustrates a lateral sectional view of the terminal block in accordance with FIG. 1 having a closed release element (release lever) and consequently a closed clamping site of the resilient force clamping connection.
Figure 2B:
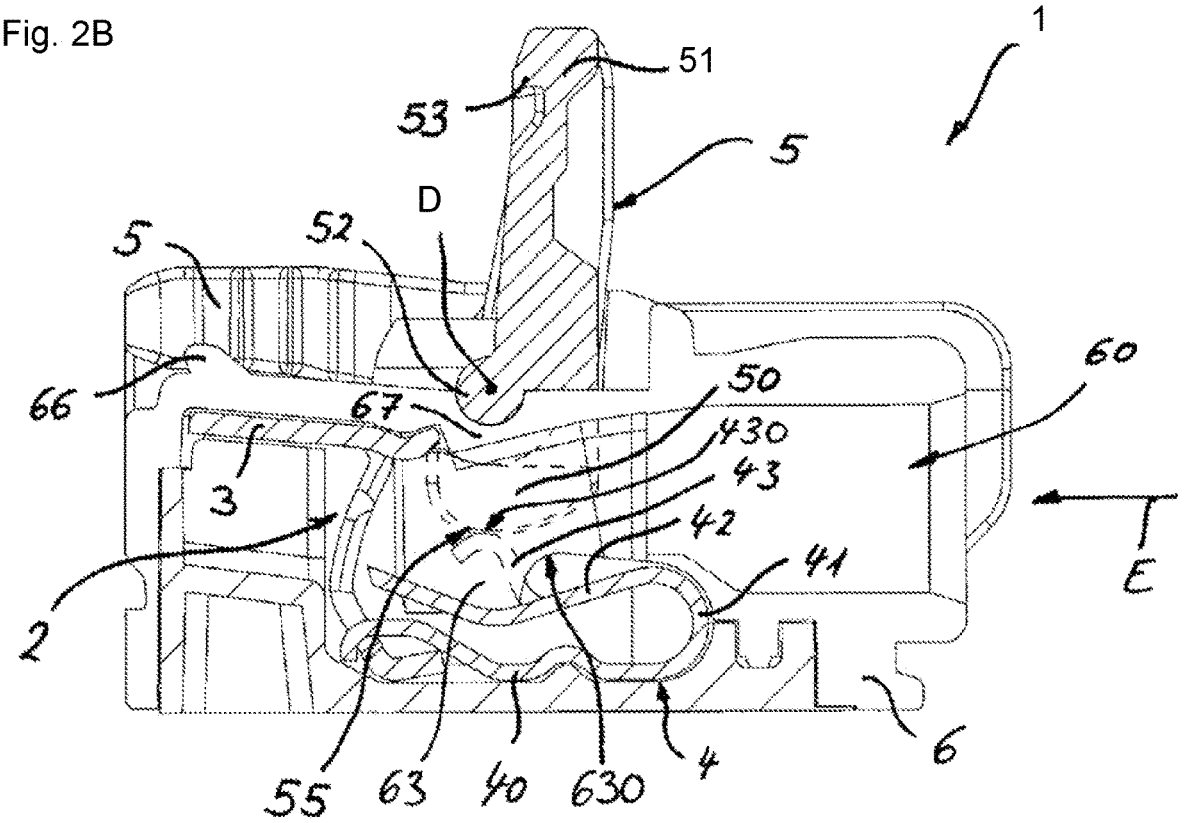
FIG. 2B illustrates a lateral sectional view of the terminal block in accordance with FIG. 1 having an open release element (release lever) and consequently an open clamping site of the resilient force clamping connection.
Figure 3A:
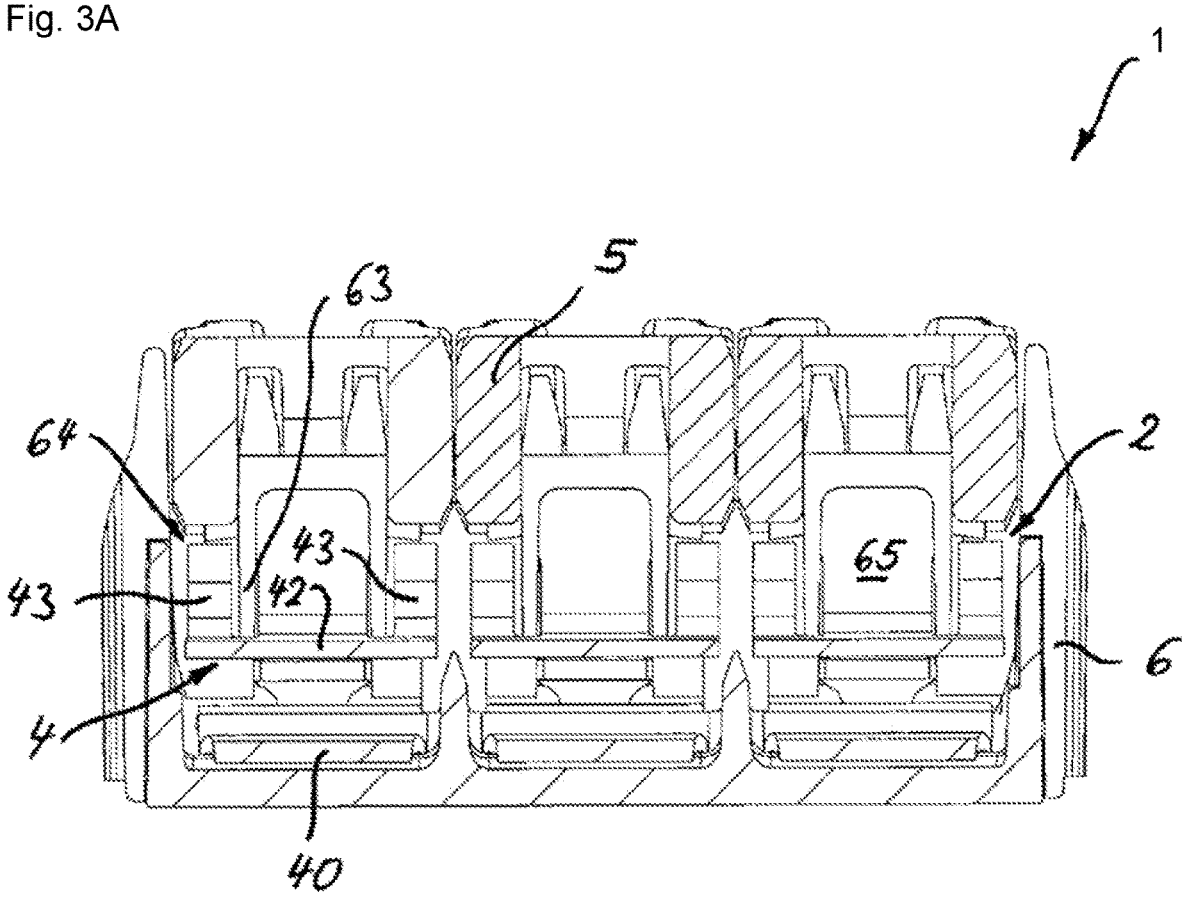
FIG. 3A illustrates a frontal sectional view of the terminal block in accordance with FIG. 1 having a closed release element (release lever) and consequently a closed clamping site of the resilient force clamping connection.
Figure 3B:
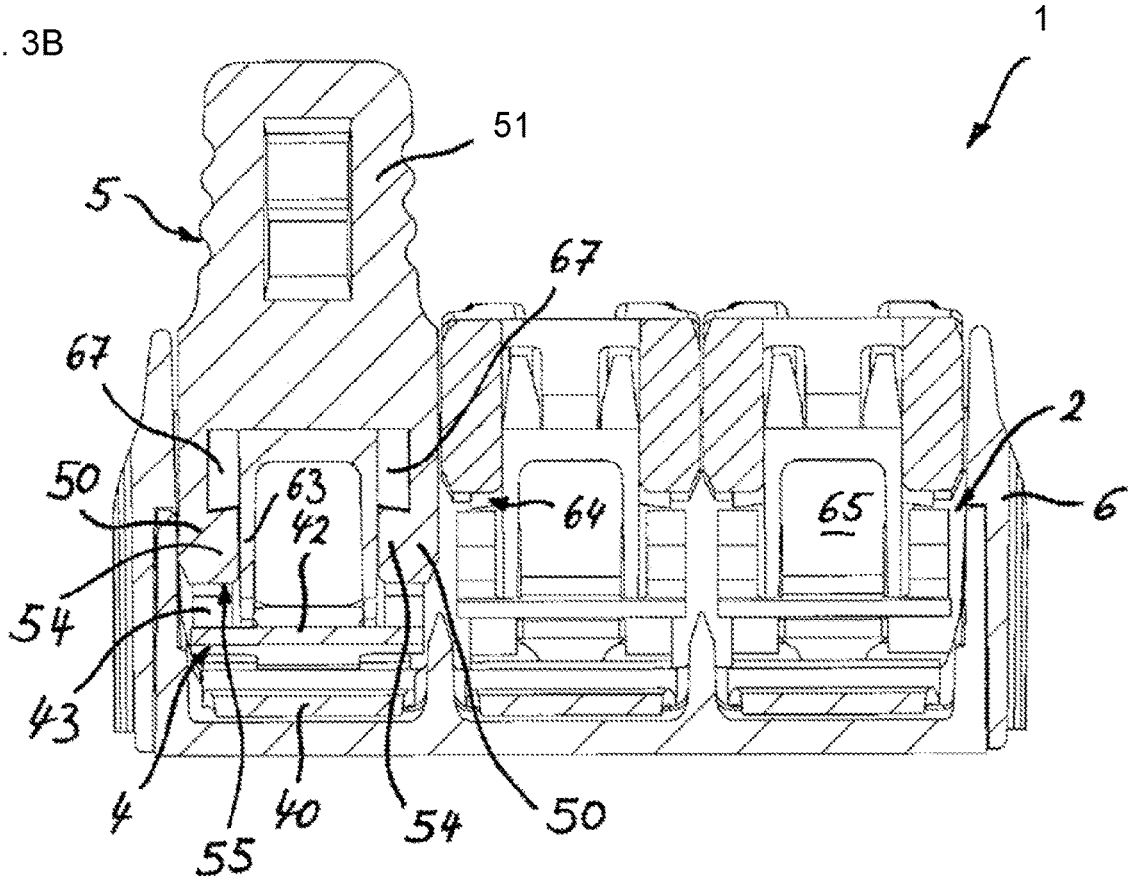
FIG. 3B illustrates a frontal sectional view of the terminal block in accordance with FIG. 1 having an open release element (release lever) and consequently an open clamping site of the resilient force clamping connection.
Figure 5A:
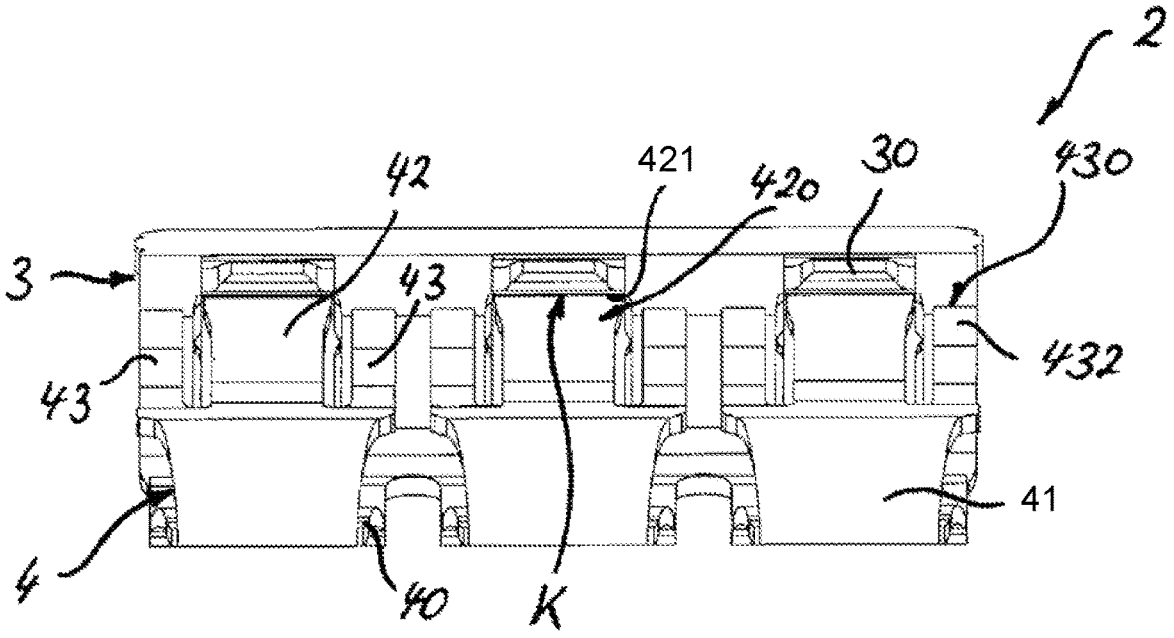
FIG. 5A illustrates a frontal view of the resilient force clamping connection in accordance with the invention in accordance with the exemplary embodiment.
Figure 5B:
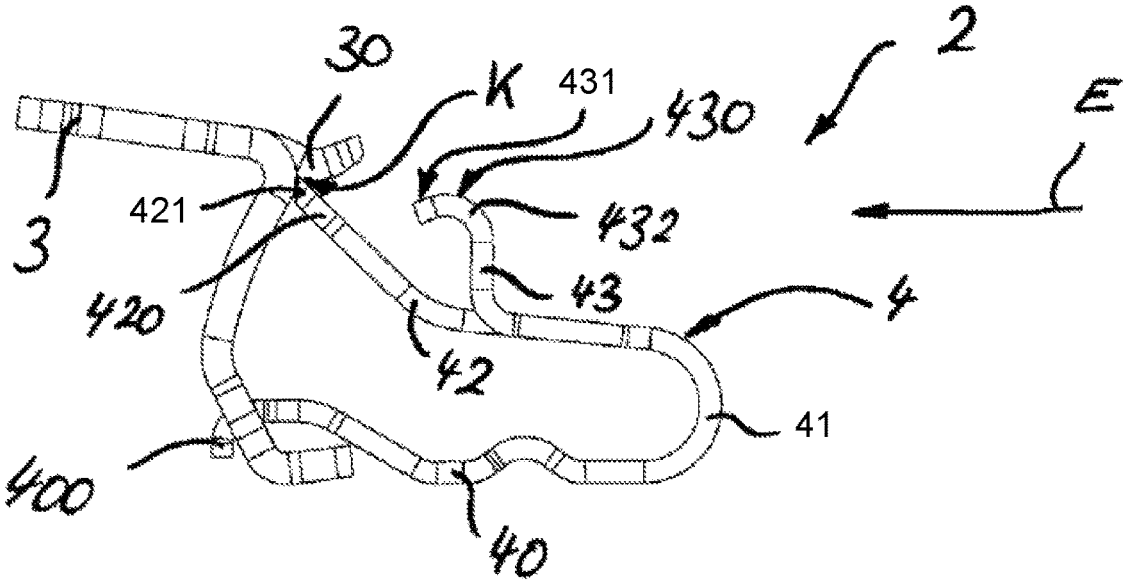
FIG. 5B illustrates a lateral view of the resilient force clamping connection in accordance with FIG. 5A.
Figure 5C:
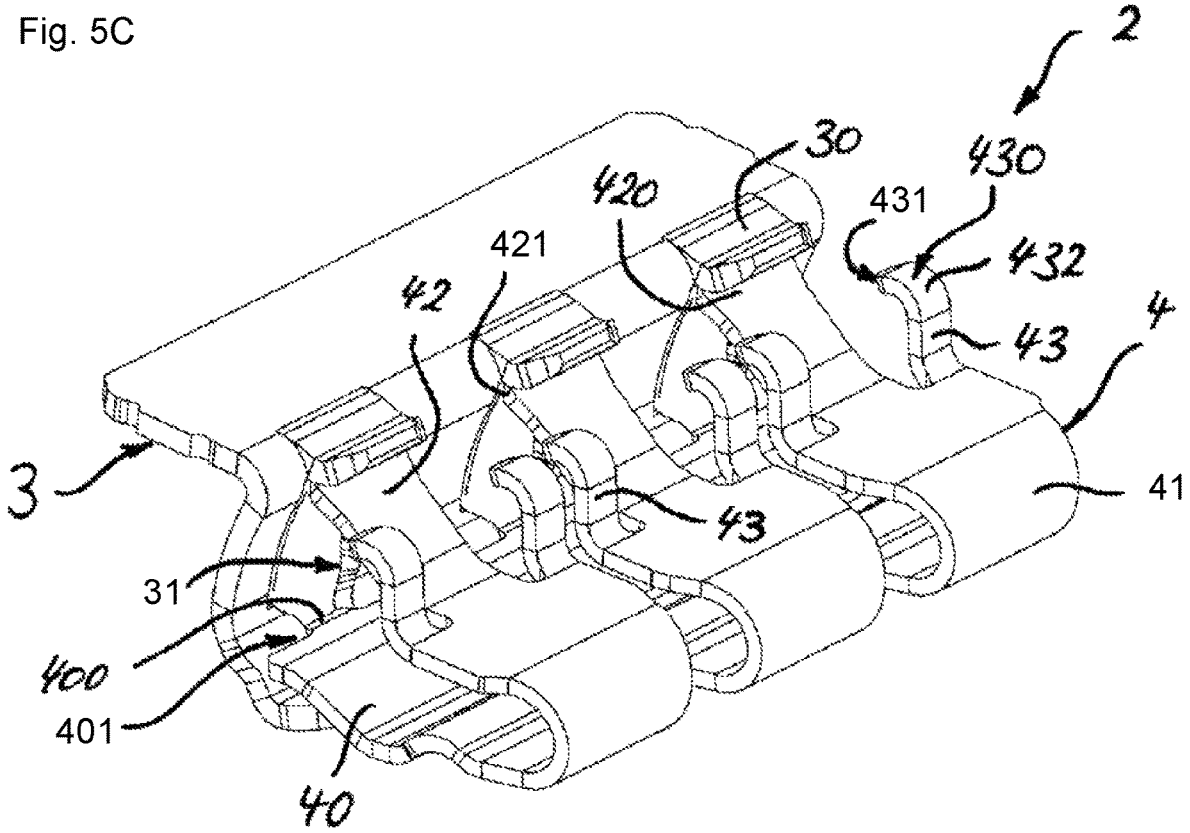
FIG. 5C illustrates a perspective view of the resilient force clamping connection in accordance with FIG. 5A.

As is apparent for example in FIGS. 2A, 2B and 5C, the busbar 3 can comprise a conductor feedthrough opening 31. This is preferably provided downstream of the clamping site K when viewed in a conductor feed-in direction E. Consequently, it is possible for a conductor that is connected to the resilient force clamping connection 2 to be received securely in the busbar 3, whereby a secure electrical contact is ensured.

The clamping spring 4 is preferably mounted with its support limb 40 in the busbar 3. It is preferred, as illustrated in FIGS. 5B and 5C, that the support limb 40 is clipped for this purpose in the busbar 3; this is preferably with a mounting section 400 against a free end 401 of the support limb, said free end being opposite the resilient bend 41. It is particularly preferred for this purpose that the support limb 40 can be mounted or rather clipped in on a mounting side 32 of the conductor feedthrough opening 31 or rather of the busbar 3 in such a manner that the clamping limb 42 lies against the busbar 3 at a side 33 that is remote from the mounting side 32 so as to form the conductor clamping site K and optionally in the case of an open conductor clamping site K reveals the conductor feedthrough opening 31 at least in part in the conductor feed-in direction E, such as is apparent for example when viewing FIGS. 5A, 4A and 4C.

In accordance with the invention, at least one actuating limb 43 extends from the clamping limb 42 between the resilient bend 41 and the free end 420 in a direction away from the support limb 40; thus therefore directed away in the upwards direction in the illustrated Figures.

As is particularly apparent in FIGS. 5A and 5C, in this case the actuating limb 43 preferably extends at the side of the clamping limb 42 accordingly away from the clamping limb 42. In the preferred embodiment illustrated here, the clamping spring 4 comprises here two actuating limbs 43. These then preferably extend on both sides of the clamping limb 42 accordingly away from the clamping limb 42.

The actuating limb 43 comprises an actuating section 430 in order to cooperate with a release element 5 so as to open the conductor clamping site K.

As is apparent for example in FIGS. 4 and 5, the actuating section 430 can be provided at a free end 431 of the actuating limb 43, said free end being remote from the clamping limb 42.

As is apparent for example in FIGS. 4 and 5, the actuating limb 43 can comprise at the free end 431 that is remote from the clamping limb 42, preferably on the actuating section 430, a bend section 432 that is preferably curved in the direction of the clamping section or rather of the clamping edge 421 or of the conductor clamping site K. It is thus possible for a release element 5 to engage with the actuating limb 43 in a particularly simple manner, as is apparent for example in FIGS. 2 and 4.

Fundamentally, the respective limbs of the clamping spring 4 (in other words: support limb 40, resilient bend 41, clamping limb 42, actuating limb 43) can comprise any desired number of sections that are bent and/or curved toward one another. The clamping spring 4 or rather its resilient bend 41 is also not limited to a U-shape.

The above mentioned terminal block 1 in accordance with the invention is now described below in particular with reference to FIGS. 1 to 3.

The terminal block 1 comprises an insulated housing 6 and at least one resilient force clamping connection 2 in accordance with the invention that is received in the insulated housing 6 at least in part and here completely, as has already been described above by way of example with reference to FIGS. 2 to 5.

The insulated housing 6 can comprise for each clamping site K or rather clamping spring 4 at least one conductor feed-in duct 60 that extends in a conductor feed-in direction E to the conductor clamping site K. When viewed in the conductor feed-in direction E, this duct 60 is delimited preferably around all sides by the insulated housing which as a result forms a preferably circumferentially closed duct wall 61 and consequently the conductor feed-in duct 60 that is illustrated here. The conductor feed-in duct 60 tapers preferably toward the clamping site K so as to form a conductor feed-in funnel in order to guide the conductor in a simple manner securely to the clamping site K.

It is preferred that the resilient force clamping connection 2 is provided in the insulated housing 6 in such a manner that the clamping spring 4 is oriented with the resilient bend 41 facing a feed-in opening 62 of the conductor feed-in duct 60, as is particularly apparent in FIGS. 2A and 2B. The clamping spring 4 is thus arranged in such a manner that the support limb 40 and the clamping limb 42 extend in the conductor feed-in direction E away from the resilient bend 41 to the clamping site K. In this case, the clamping limb 42 is preferably arranged in such a manner that in the closed idle position of the clamping spring 4 or rather of the clamping site K said clamping limb passes transversely through the conductor feed-in duct 60 and consequently serves as a feed-in chamfer for a conductor that is to be fed into the resilient force clamping connection 2 or rather is fed into the conductor feed-in duct 60.

The clamping limb 42 and each of the actuating limbs 43, at least of the actuating section 430 of the respective actuating limb 43, can be separated from one another by means of a partition wall 63 that is formed by the insulated housing 6; this preferably in each actuating position of the clamping spring 4. This is indicated by way of example in FIGS. 2A and 2B by means of dashed lines of the actuating limb 43 and is apparent in FIGS. 3A and 3B. As is likewise apparent in the Figures mentioned, in accordance with the illustrated embodiment the partition wall 63 preferably delimits the conductor feed-in duct 60 at least in part laterally. Consequently, it is possible to provide a spatial separation between the conductor feed-in duct 60 or rather a clamping space 65 on the one hand and an actuating space 64 that receives the actuating limb 43 or rather actuating sections 430 on the other hand. The partition wall 63 preferably comprises a recess 630 in order in the case of a spatially separated clamping limb 42 and actuating limb 43 or rather actuating section 430 to render possible an appropriate separation over the entire movement path of the clamping spring 4 (in other words of the clamping limb 42 and consequently of the actuating limb 43).

The actuating limb 43 that protrudes upwards here provides a possibility for shortening the access path of a release element to the actuating section. Consequently, it is not necessary for a release element to advance as far as the "actual clamping spring 4" (in other words in particular as far as the clamping limb 42) since the clamping spring 4 can already be actuated at the upright tab (in other words the actuating limb 43). It is conceivable for example to use as a release element a separate part, such as for example a screw driver, with which the actuating limb 43 or rather its actuating section 430 is gripped and thus the clamping limb 42 can be moved here downward so as to open the clamping site K. For this purpose, the insulated housing can comprise an appropriate through-going duct between the actuating section 430 and the outer side of the terminal block 1 (here for example directed upward away from the actuating section 430). It is also conceivable to provide a pusher in such a duct.

In accordance with a particularly preferred embodiment, however, it is also conceivable that the terminal block 1 itself moreover comprises a release element 5, such as a release lever that is illustrated here or also a release slide. The release element 5 can then be moved between an idle position (cf. for example FIGS. 1, 2A, 3A, 4A) in which the clamping limb 42 pushes into a closed position of the conductor clamping site K, and an actuating position (cf. for example FIGS. 2B, 3B, 4C) in which the release element 5 cooperates with the actuating limb 43 (or rather its actuating section 430) in such a manner that the conductor clamping site K is opened. By virtue of providing the actuating section 430 as a bend section 432, it is possible to perform an actuation in a safe and simple manner during the entire movement path of the release element 5.

The release element 5 can preferably be arranged on a side of the clamping limb 42, said side lying opposite the support limb 40, (in other words here above the clamping limb 42), whereby the release element 5 can be positioned in a particularly favorable manner and close to the actuating section 430.

The release element 5 is preferably embodied in a planar manner and, as is particularly apparent in FIGS. 2 to 4, extends particularly preferably essentially in one plane.

Figure 4A:
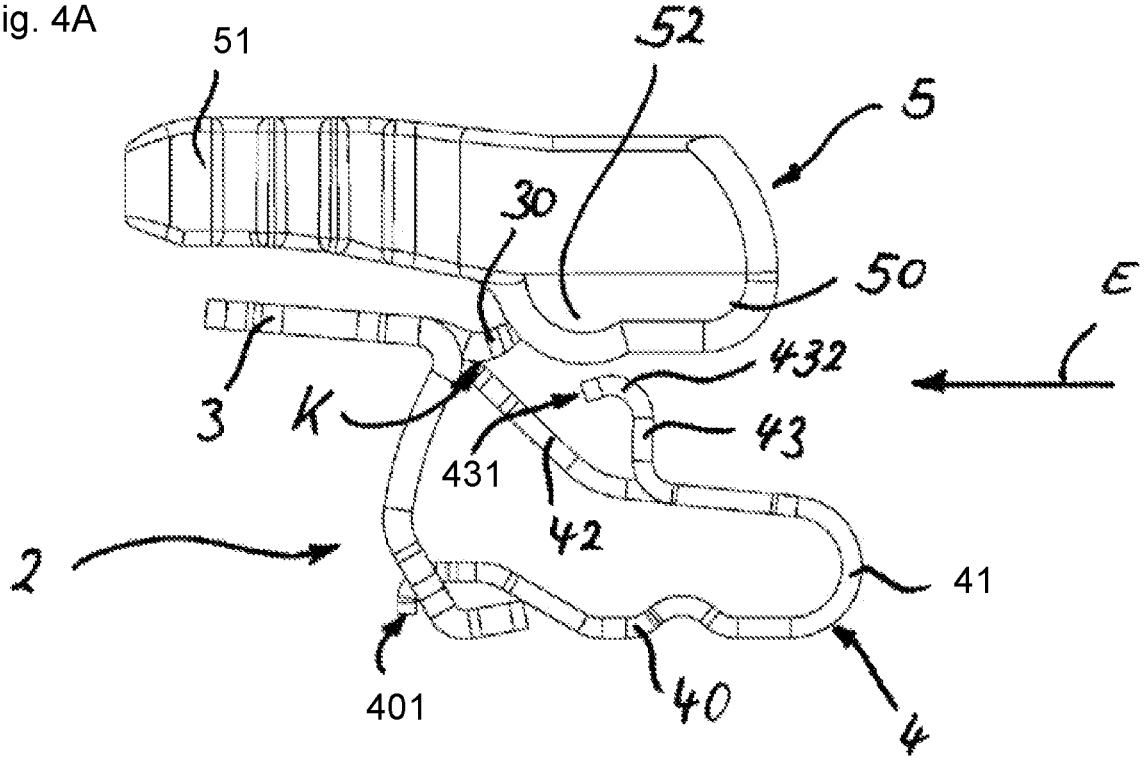
FIG. 4A illustrates a lateral view of the resilient force clamping connection in accordance with the invention and a lateral view of the release element (release lever) of the terminal block in accordance with FIG. 1 having a closed release element (release lever) and consequently a closed clamping site of the resilient force clamping connection.
Figure 4B:
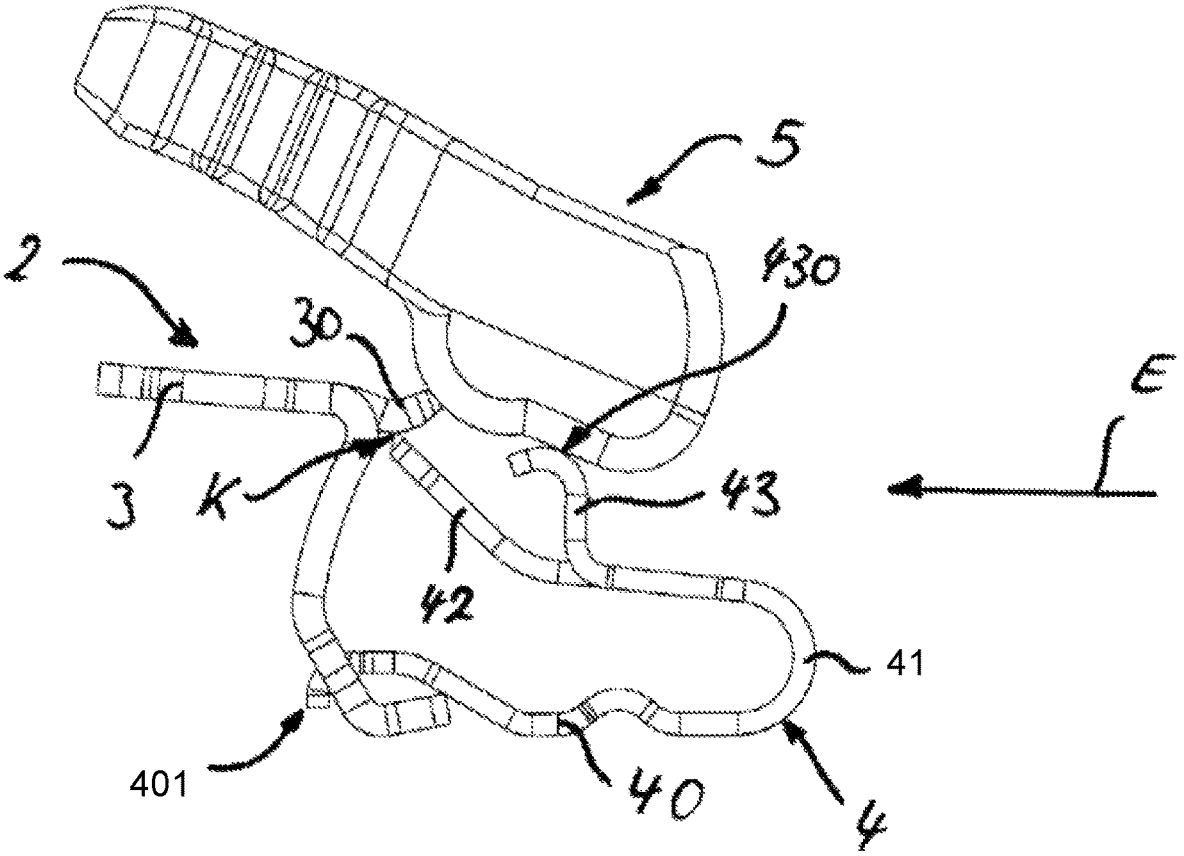
FIG. 4B illustrates a lateral view of the resilient force clamping connection in accordance with the invention and a lateral view of the release element (release lever) of the terminal block in accordance with FIG. 1 having a slightly open release element (release lever) and a still closed clamping site of the resilient force clamping connection.
Figure 4C:
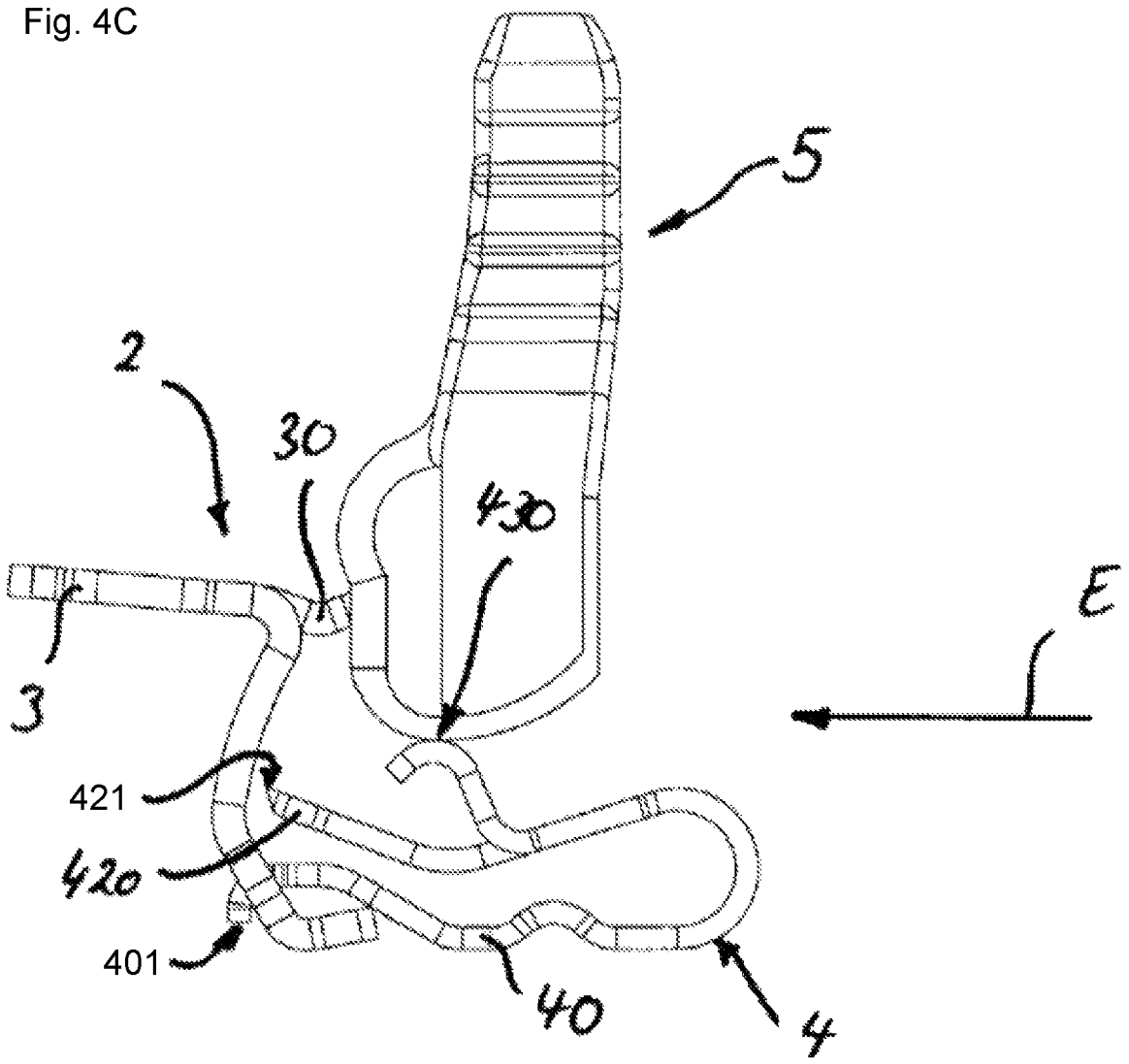
FIG. 4C illustrates a lateral view of the resilient force clamping connection in accordance with the invention and a lateral view of the release element (release lever) of the terminal block in accordance with FIG. 1 having a closed release element (release lever) and consequently a closed clamping site of the resilient force clamping connection.

As is apparent for example in FIGS. 1, 2A and 4A, in the idle position the release element 5 can extend preferably along one side (here the upper side) of the insulated housing 6 or essentially laterally (here the upper side/above) with respect to the resilient force clamping connection 2 or laterally (here the upper side/above) with respect to the conductor feed-in duct 60 or parallel to a conductor feed-in direction E in order to form a terminal block 1 that is embodied in a particularly planar manner.

The release element 5 can comprise a clamping spring actuating section 50 with which it cooperates at least in the actuating position (cf. for example FIGS. 2B, 3B, 4C) with the actuating limb 43, preferably with the actuating section 430 of said actuating limb, so as to open the conductor clamping site K. Moreover, the release element 5 can comprise a lever actuating section 51 so that a user can move the release element 5 between the idle position and the actuating position. The clamping spring actuating section 50 and the lever actuating section 51 can be provided in this case preferably on opposite-lying ends of the release element 5, such as is clearly apparent in FIGS. 2 to 4.

The release element 5 can be moved in different manners between the idle position and the actuating position; preferably in a defined movement. Thus, as illustrated in the exemplary embodiment, the release element 5 can be mounted for example in a rotational manner in the housing in order for said release element to be moved between the idle position and the actuating position. It is also conceivable to mount the release element in the housing in a translational manner (for example by means of a release slide) or also in a rotational and translational manner.

In the case of the rotational mounting illustrated here, an axis of rotation D of the release element 5 can preferably extend in a transverse manner or perpendicular to the resilient force clamping connection 2 and preferably to a conductor feed-in direction E or to the conductor feed-in duct 60. As is particularly apparent in FIGS. 2 and 3, the axis of rotation D can in this case particularly preferably extend laterally outside (here above) the conductor feed-in duct 60.

The release element 5 can preferably comprise mounting sections 52 so as to provide the rotational and/or translational mounting in the insulated housing 6. In this case, it can be an axis section 52 that is illustrated here by way of example and that is embodied here about the axis of rotation D in order to render it possible for the release element 5 to pivot about the axis of rotation. The mounting section 52 is in this case preferably mounted in corresponding mounting sections 64 of the insulated housing 6. In the case of a translational mounting arrangement, it is conceivable that the release lever 5 on the one hand and the insulated housing on the other hand comprise a corresponding mounting section in the form of rail-like guides. The mounting sections 52 are preferably arranged between the clamping spring actuating section 50 and the lever actuating section 51, as is particularly apparent in FIGS. 2 and 3.

Moreover, the release element 5 can comprise latching structures 53 with which it can be releaseably fixed here preferably at least in the idle position. The latching structures 53 cooperate in this case preferably in a latching manner with corresponding latching structures 66 of the insulated housing 6, as is apparent for example in FIG. 2A.

The clamping spring actuating section 50 can preferably comprise an actuating mounting section 54 that protrudes in a direction parallel to the axis of rotation D. In the illustrated exemplary embodiment, the release element comprises two such actuating bearing sections 54, which here preferably protrude toward one another, as is particularly apparent in FIG. 3B. It is possible to provide between these actuating mounting sections 54 and the mounting section 52 in the insulated housing 6 preferably a guiding bend section 67 along which the actuating bearing sections 54 moves here in the case of a rotational movement about the axis of rotation and said guiding bend section supports the release element 5. The release element 5 is thus also mounted in the open actuating position securely in the insulated housing 6. The release element 5 then comprises at its side remote from the guiding bend section 67 a release actuating section 55 of the clamping spring actuating section 50 which cooperates with the actuating section 430 so as to open the clamping spring 4. In this case, the release actuating section 55 preferably comprises a curved shape in order to cooperate with the actuating section 430. Since in the actuating position of the release element 5 the clamping spring actuating section 50 or rather its release actuating section 55 is arranged between the clamping spring 4 (or rather the actuating limb 43 or its actuating section 430) on the one hand and the insulated housing 6 or its guiding bend section 67 on the other hand, it is possible to minimize the lever forces for opening the clamping site K or rather to minimize the loads on the insulated housing 6.

The present invention is not limited to the above described exemplary embodiment insofar as it is covered by the subject matter of the following claims.

The invention claimed is:

1. A terminal block (1) so as to electrically connect at least one conductor, said terminal block comprising an insulated housing (6) and at least one resilient force clamping connection (2) that is received at least in part by the insulated housing (6), wherein the resilient force clamping connection (2) comprises:

a busbar (3), and a clamping spring (4) having a support limb (40), a resilient bend (41) that adjoins the support limb (40), and a clamping limb (42) that adjoins the resilient bend (41), wherein the clamping limb (42) comprises at a free end (420) that is remote from the resilient bend (41) a clamping section (421) so as to form a conductor clamping site (K) between the clamping section (421) and the busbar (3) so as to electrically connect a conductor (L) to the resilient force clamping connection (2), wherein at least one actuating limb (43) extends from the clamping limb (42) between the resilient bend (41) and the free end (420) in a direction away from the support limb (40), wherein the actuating limb (43) comprises an actuating section (430) in order to cooperate with a release element (5) so as to open the conductor clamping site (K), wherein the clamping limb (42) and the actuating section (430) of the actuating limb (43) are separated from one another by means of a partition wall (63) that is formed by the insulated housing (6).

2. The terminal block (1) in accordance with claim 1, wherein at least the resilient bend (41) or the clamping spring (4) is embodied essentially in a U-shaped manner.

3. The terminal block (1) in accordance with claim 1, wherein the actuating limb (43) extends laterally with respect to the clamping limb (42).

4. The terminal block (1) in accordance with claim 1, wherein the actuating section (430) is provided at a free end (431) of the actuating limb (43), said free end being remote from the clamping limb (42).

5. The terminal block (1) in accordance with claim 1, wherein the actuating limb (43) comprises, on the actuating section (430), a bend section (432) that is curved in the direction of the clamping section (421) or of the conductor clamping site (K).

6. The terminal block (1) in accordance with claim 1, wherein the busbar (3) comprises a conductor feedthrough opening (31).

7. The terminal block (1) in accordance with claim 6, wherein the clamping spring (4) with its support limb (40) is mounted in the busbar (3) on a mounting side (32) of the conductor feedthrough opening (31) in such a manner that the clamping limb (42) lies at a side (33) that is remote from the mounting side (32) against the busbar (3) so as to form the conductor clamping site (K) and in the case of an open conductor clamping site (K) reveals the conductor feedthrough opening (31) at least in part in a conductor feed-in direction (E).

8. The terminal block (1) in accordance with claim 1, wherein the clamping section (421) is embodied as a clamping edge.

9. The terminal block (1) in accordance with claim 1, wherein the terminal block (1) is a connection terminal or connecting terminal.

10. The terminal block (1) in accordance with claim 9, wherein the clamping limb (42) and each of the actuating limbs (43) are separated from one another by means of the partition wall (63) in each actuating position of the clamping spring (4).

11. The terminal block (1) in accordance with claim 1, wherein the insulated housing (6) comprises for each conductor clamping site (K) at least one conductor feed-in duct (60) that extends in a conductor feed-in direction (E) to the conductor clamping site (K), wherein the partition wall (63) delimits the conductor feed-in duct (60) at least in part laterally.

12. The terminal block (1) in accordance with claim 1 moreover comprising a release element (5), which can be moved between an idle position in which the clamping limb (42) pushes into a closed position of the conductor clamping site (K), and an actuating position in which the release element (5) cooperates with the actuating limb (43) in such a manner that the conductor clamping site (K) is opened.

13. The terminal block (1) in accordance with claim 12, wherein the release element (5) is arranged on a side of the clamping limb (42), said side lying opposite the support limb (40).

14. The terminal block (1) in accordance with claim 12, wherein the release element (5) is embodied in a planar manner, wherein in the idle position the release element (5) extends along one side of the insulated housing (6) or essentially laterally with respect to the resilient force clamping connection (2) or laterally with respect to the conductor feed-in duct (60) or parallel to a conductor feed-in direction (E).

15. The terminal block (1) in accordance with claim 12, wherein the release element (5) comprises a clamping spring actuating section (50) with which it cooperates at least in the actuating position with the actuating section (430) of said actuating limb (43), so as to open the conductor clamping site (K), and said release element comprises a lever actuating section (51) so as to move the release element (5) between the idle position and the actuating position.

16. The terminal block (1) in accordance with claim 15, wherein the clamping spring actuating section (50) and the lever actuating section (51) are provided on opposite-lying ends of the release element (5).

17. The terminal block (1) in accordance with claim 12, wherein the release element (5) is mounted in a rotational manner or a translational manner or a rotational and translational manner in the insulated housing (6) in order to be moved between the idle position and the actuating position.

18. The terminal block (1) in accordance with claim 17, wherein in the case of a rotational mounting, an axis of rotation (D) of the release element (5) extends in a transverse manner or perpendicular manner to the resilient force clamping connection (2) and to a conductor feed-in direction (E) or to the conductor feed-in duct (60), wherein the axis of rotation (D) extends laterally outside the conductor feed-in duct (60).

19. The terminal block (1) in accordance with claim 12, wherein the release element (5) comprises mounting sections (52) for the rotational mounting or for the translational mounting or for the rotational and translational mounting in the insulated housing (6), wherein the mounting sections (52) are arranged between the clamping spring actuating section (50) and the lever actuating section (51).

20. The terminal block (1) in accordance with claim 1, wherein two actuating limbs (43) extend on both sides of the clamping limb (42) and away from the clamping limb (42).

* * * * *